US007845830B2

(12) United States Patent
Chan

(10) Patent No.: US 7,845,830 B2
(45) Date of Patent: Dec. 7, 2010

(54) ADJUSTABLE LIGHTING DEVICE

(75) Inventor: Daniel Pak Ming Chan, Hong Kong (HK)

(73) Assignee: Beam Matrix Limited, Hong Kong (HK)

( * ) Notice: Subject to any disclaimer, the term of this patent is extended or adjusted under 35 U.S.C. 154(b) by 110 days.

(21) Appl. No.: 12/417,071

(22) Filed: Apr. 2, 2009

(65) Prior Publication Data

US 2009/0290351 A1 Nov. 26, 2009

Related U.S. Application Data

(60) Provisional application No. 61/055,991, filed on May 25, 2008.

(51) Int. Cl.
*F21S 8/00* (2006.01)

(52) U.S. Cl. ..... 362/277; 362/418; 362/419; 362/427; 362/429; 362/235; 362/232; 362/271; 362/272

(58) Field of Classification Search ..... 362/277, 362/536, 524, 232, 268, 271, 272, 284, 286, 362/287, 418, 419, 427, 429
See application file for complete search history.

(56) References Cited

U.S. PATENT DOCUMENTS 1,427,329 A * 8/1922 Reiber ..... 362/359
3,375,362 A * 3/1968 Klippert ..... 362/33
7,748,869 B2 * 7/2010 Sevack et al. ..... 362/277

* cited by examiner

*Primary Examiner*—Anabel M Ton

(57) ABSTRACT

An adjustable lighting device includes a light source, a reflector for reflecting light from the light source, a coil of nonlinear thread coiling around the reflector, and a driving member engaging with the coil of nonlinear thread. The driving member is adapted to drive the coil of nonlinear thread to rotate thereby adjusting the position of the reflector.

20 Claims, 10 Drawing Sheets

ADJUSTABLE LIGHTING DEVICE

CROSS-REFERENCE TO RELATED PATENT APPLICATIONS

This application claims priority of U.S. provisional patent application No. 61/055,991 filed on May 25, 2008, the entire content of which is hereby incorporated by reference.

FIELD OF PATENT APPLICATION

The present patent application relates to a lighting device with adjustable beam size and beam direction.

BACKGROUND

Most of the existing lighting devices were installed with little consideration of minimizing energy wastage. Very often all the lights inside a room can only be turned on and off together, or dimmed on and off together. Over-illumination happens when only one area of the room requires illumination but other parts of the room are also illuminated because of the inflexibility of the existing lighting device. There are several ways to tackle the problem. One way is to re-install new lighting system having functions similar to stage lighting in order to enable a user to control the illumination of each individual light (i.e. light output, beam size and beam direction). However, the high cost of installation will prohibit most users from doing it this way. Another way is to install a do-it-yourself type home automation product which has a remote control unit for controlling each plug-in lamp to operate at on/off/dimming modes independently with an intermediate adaptor between a plug-in lamp and a wall power socket. Lighting fixtures can be controlled in groups with the wall mounted dimming control units. However, it is rather complicated for a user to install this do-it-yourself type lighting product. Hence, there is a need to produce an improved adjustable lighting device that is simple, easy to install, and less expensive.

The above description of the background is provided to aid in understanding an adjustable lighting device, but is not admitted to describe or constitute pertinent prior art to the adjustable lighting device disclosed in the present patent application, or consider any cited documents as material to the patentability of the claims of the present patent application.

SUMMARY

An adjustable lighting device includes a light source, a reflector for reflecting light from the light source, a coil of nonlinear thread coiling around the reflector, and a driving member engaging with the coil of nonlinear thread. The driving member is adapted to drive the coil of nonlinear thread to rotate thereby adjusting the position of the reflector.

In one embodiment, the coil of nonlinear thread frictionally engages with the driving member and is rotatable by the driving member via friction.

In one embodiment, the coil of nonlinear thread is rotatable by the driving member via gear mechanism.

In one embodiment, the coil of nonlinear thread includes a helical groove along which a projection of the driving member engages.

In one embodiment, the coil of nonlinear thread includes a helical projection along which a groove of the driving member engages.

In one embodiment, the driving member is in the form of a rotatable driving wheel.

In one embodiment, the coil of nonlinear thread includes a plurality of reinforcing rod members attached to the coil of nonlinear thread.

In one embodiment, the coil of nonlinear thread is fixedly attached to an outer surface of the reflector.

In one embodiment, tone end of the coil of nonlinear thread is fixedly mounted to the reflector.

In one embodiment, the coil of nonlinear thread is embedded in an outer surface of the reflector.

The adjustable lighting device may further include two supporting members along with the driving member to provide a three-point support for the coil of nonlinear thread. The supporting members may be freely rotatable wheels.

The adjustable lighting device may further include a shaft on which the light source is supported, and a motor adapted to drive the shaft axially along an axis of the shaft thereby moving the light source in or out of a focal point of the reflector.

BRIEF DESCRIPTION OF THE DRAWINGS

Specific embodiments of the adjustable lighting device disclosed in the present patent application will now be described by way of example with reference to the accompanying drawings wherein.

DETAILED DESCRIPTION

Reference will now be made in detail to a preferred embodiment of the adjustable lighting device disclosed in the present patent application, examples of which are also provided in the following description. Exemplary embodiments of the adjustable lighting device disclosed in the present patent application are described in detail, although it will be apparent to those skilled in the relevant art that some features that are not particularly important to an understanding of the adjustable lighting device may not be shown for the sake of clarity.

Furthermore, it should be understood that the adjustable lighting device disclosed in the present patent application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

Figure 1:
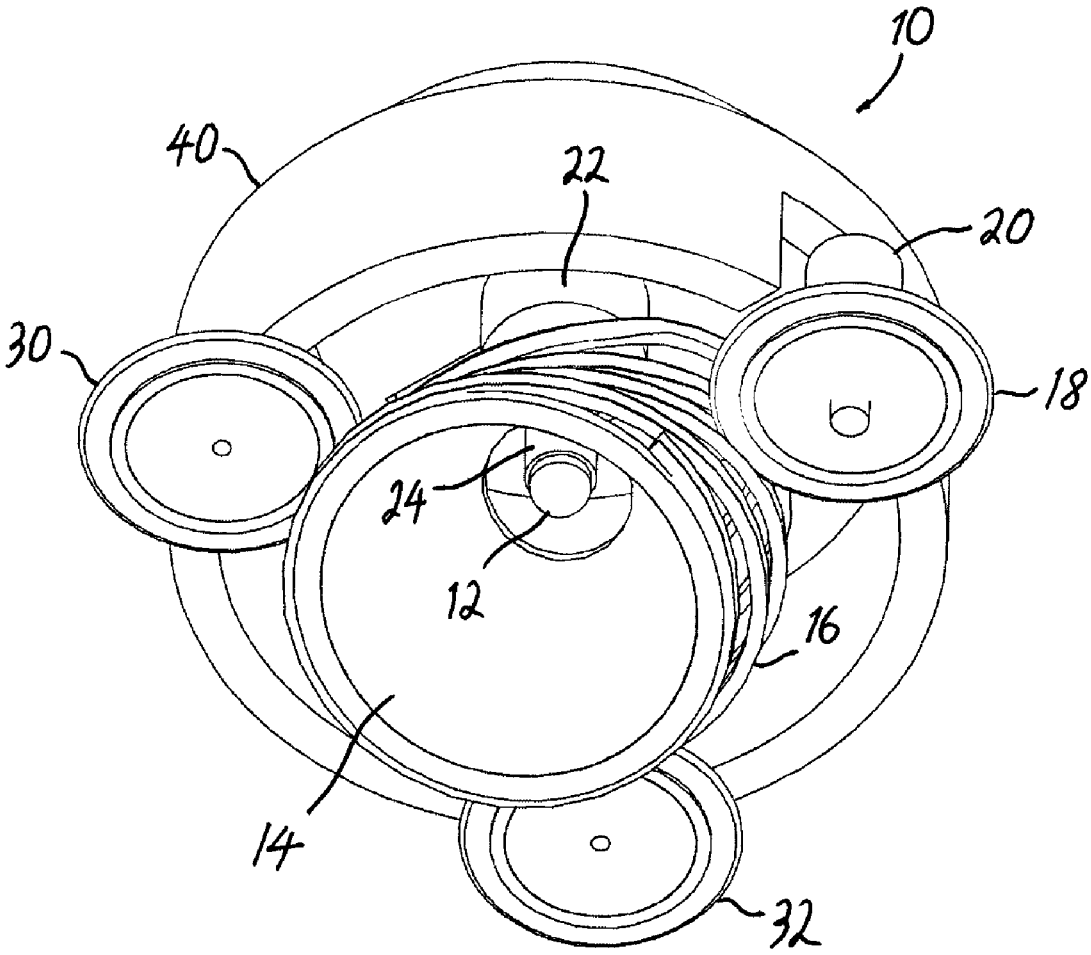
FIG. 1 is a perspective view of an adjustable lighting device in accordance with an embodiment disclosed in the present patent application.
Figure 2:
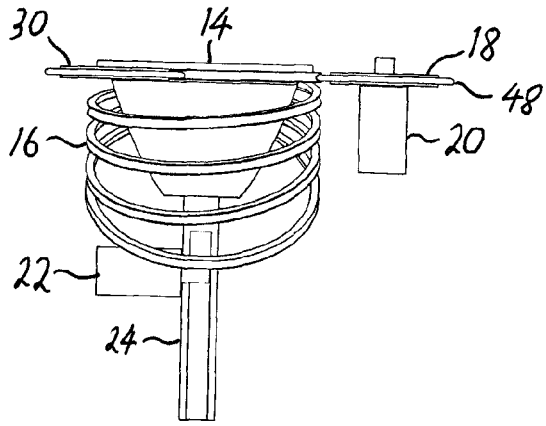
FIG. 2 is a side view of the adjustable lighting device in FIG. 1.
Figure 3:
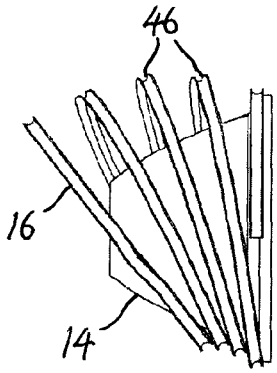
FIG. 3 is a side view of a coil of nonlinear thread mounted on a reflector of the adjustable lighting device.
Figure 4:
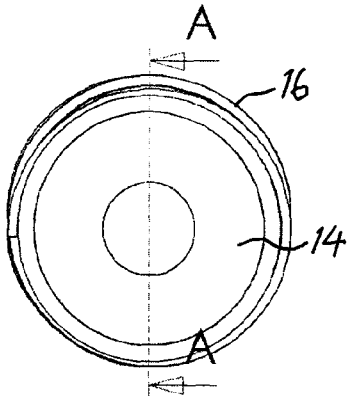
FIG. 4 is a front view of the coil of nonlinear thread and the reflector in FIG. 3.
Figure 5:
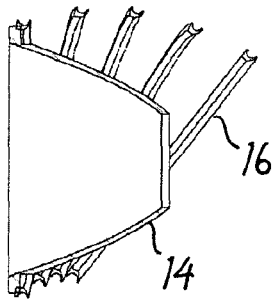
FIG. 5 is a cross sectional view taken along line A-A of the coil of nonlinear thread and the reflector in FIG. 4.
Figure 6:
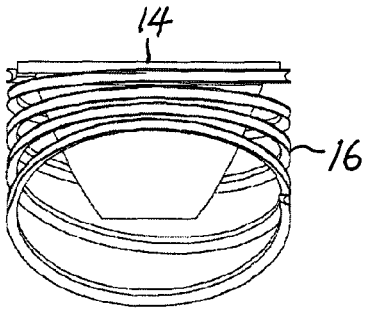
FIG. 6 is a bottom view of the coil of nonlinear thread and the light reflector in FIG. 3.
Figure 7:
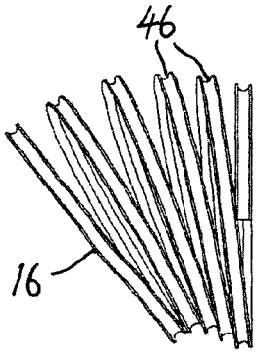
FIG. 7 is a side view of the coil of nonlinear thread of the adjustable lighting device.
Figure 8:
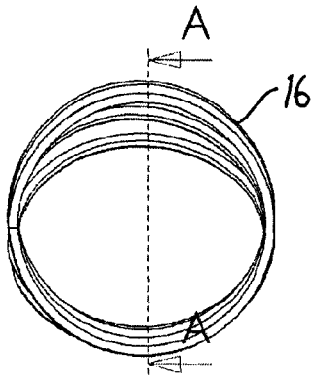
FIG. 8 is a front view of the coil of nonlinear thread in FIG. 7.

FIG. 1 is a perspective view of an adjustable lighting device 10 in accordance with an embodiment disclosed in the present patent application. The adjustable lighting device 10 may include a light source 12, a reflector 14 for reflecting light from the light source 12, a coil of nonlinear thread 16 coiling around the reflector 14, and a driving member in a form of a driving wheel 18 for driving the coil of nonlinear thread 16 together with the reflector 14 spirally around and nonlinearly outward or inward so as to adjust the angle of the reflector 14. As used herein, the term "thread" means a generally helical or spiral ridge or groove structure. Also, as used herein, the term "nonlinear thread" means a generally helical or spiral ridge or groove having nonlinear characteristics, such as varying pitch and coil angle, which can translate a rotational motion to a nonlinear motion, as compared to a conventional linear thread that can translate a rotational motion to a linear motion.

A beam-direction motor 20 and a beam-size motor 22 may be employed to adjust the position of the reflector 14 and the light source 12 respectively. As used herein, the term "beam-direction motor" means a motor for changing the direction of the light beam from a light source, and the term "beam-size motor" means a motor for changing the size of the light beam from a light source. Power can be drawn from ordinary electrical contacts. As used herein, the term "electrical contacts" means contacts for drawing power from a light bulb socket or a lighting track and also command signal in case the light bulb is controlled with a wired remote control device.

A remote control may be used to remotely adjust the beam size and the beam direction of the adjustable lighting device 10 by controlling the beam-direction motor 20 and the beam-size motor 22. Alternatively, a local control in the form of a plurality of switches or press buttons may be used to control the beam-direction motor 20 and the beam-size motor 22 through electrical wires.

FIGS. 2-11 are different views of the reflector 14 and the coil of nonlinear thread 16 of the adjustable lighting device 10 according to an embodiment of the present invention.

The reflector 14 may be in the form of a parabolic reflector, or a combination of lens and reflector. The reflector 14 collimates light from the light source 12 to form a light beam. One end of the coil of nonlinear thread 16 is fixedly mounted at a front end of the reflector 14. The diameter of the coil of nonlinear thread 16 can be larger than the diameter of the reflector 14. The coil of nonlinear thread 16 substantially coils around the outer surface of the reflector 14. The other end of the coil of nonlinear thread 16 is a free end.

Figure 9:
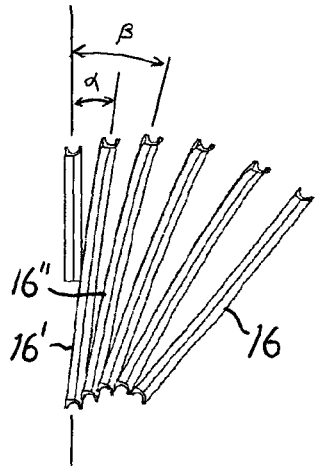
FIG. 9 is a cross sectional view taken along line A-A of the coil of nonlinear thread in FIG. 8.
Figure 10:
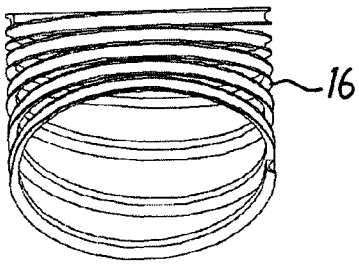
FIG. 10 is a bottom view of the coil of nonlinear thread in FIG. 7.

The coil of nonlinear thread 16 is generally in the shape of a section of an annular or toroidal coil of circular cross section with varying coil angle and coil spacing. FIG. 9 shows the coil of nonlinear thread 16 with the coil angle increasing with the number of turns away from a base of the coil of nonlinear thread 16. The first coil 16' has a coil angle $\alpha$ and the second coil 16" has a coil angle $\beta$ from the base of the coil. The coil of nonlinear thread 16 has a height of about 42 mm at the side with larger coil spacing and a height of about 12 mm at the other side with smaller coil spacing.

According to the illustrated embodiment, a spiral groove 46 of rounded cross section is integrally formed along the entire length of the coil of nonlinear thread 16. The groove 46 frictionally engages with a projected circular edge 48 of the driving wheel 18. The circular edge of the driving wheel 18 and the support wheels 30, 32 may be made of a soft material (e.g. silicone plastic) to facilitate frictional engagement of the coil of nonlinear thread 16 with the driving wheel 18, and the support wheels 30, 32 during rotation.

Although it has been shown and described that a groove 46 is formed on the coil of nonlinear thread 16 to engage with the circular edge 48 of the driving wheel 18, it is understood by one skilled in the art that other forms of engagement can be adopted. For example, the coil of nonlinear thread 16 may have a circular cross section for frictional engagement with an outwardly facing annular groove provided on the driving wheel 18. Also, the driving wheel 18 can be in the form of any other suitable rotatable member so long as it can engage with the coil of nonlinear thread 16 and frictionally drive the coil of linear thread 16 to rotate. Furthermore, although it has been shown that the coil of nonlinear thread 16 is rotatable by the driving wheel 18 by friction, it is understood by one skilled in the art that the coil of nonlinear thread 16 can be driven by the driving wheel 18 by other possible mechanism such as gear mechanism.

Figure 11:
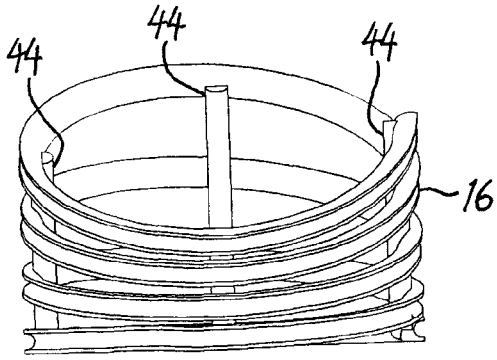
FIG. 11 is a perspective view of the coil of nonlinear thread with reinforcing rod members.

As depicted in FIG. 11, a plurality of reinforcing rod members 44 may be attached to the inner surfaces of the coil of nonlinear thread 16. The provision of the plurality of reinforcing rod members 44 fixes the position of the coiling nonlinear thread 16 and ensures precise engagement of the groove 46 with the circular edge 48 of the driving wheel 18 during rotation. In another embodiment, the coiling nonlinear thread 16 may be directly or indirectly attached to the outer surface of the reflector 14. In yet another embodiment, the coil of nonlinear thread 16 is embedded in an outer surface of the reflector 14.

Figure 12:
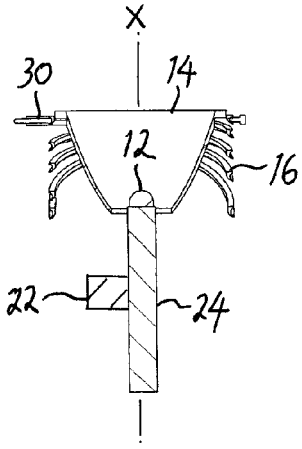
FIG. 12 is a cross sectional view of the adjustable lighting device with a light source in a "spot mode" position.
Figure 13:
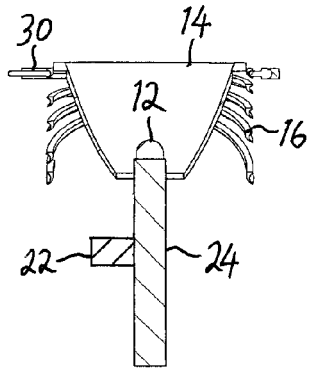
FIG. 13 is a cross sectional view of the adjustable lighting device with a light source in a "flood mode" position.

The beam-size motor 22 may include an integrated gear box and a multi-turn encoder. The beam-size motor 22 drives a thermally conductive shaft 24 through a rack and pinion mechanism, or any other appropriate mechanical linkage. The light source 12, which may be mounted at one end of the thermally conductive shaft 24, can move either outwardly or inwardly along its axis according to the direction of rotation of the beam-size motor 22. If the light source 12 is positioned at the focal point of the reflector 14, as shown in FIG. 12, the output beam size will be in a "spot" mode (small beam size). The beam size can be changed to a "flood" mode (large beam size) by adjusting the position of the light source 12 outwardly from the focal point, as illustrated in FIG. 13. An electronic controller may be used to adjust the beam size by comparing the position data from the multi-turn encoder with the target position so that electric power can be supplied to the beam-size motor 22 accordingly.

Figure 17:
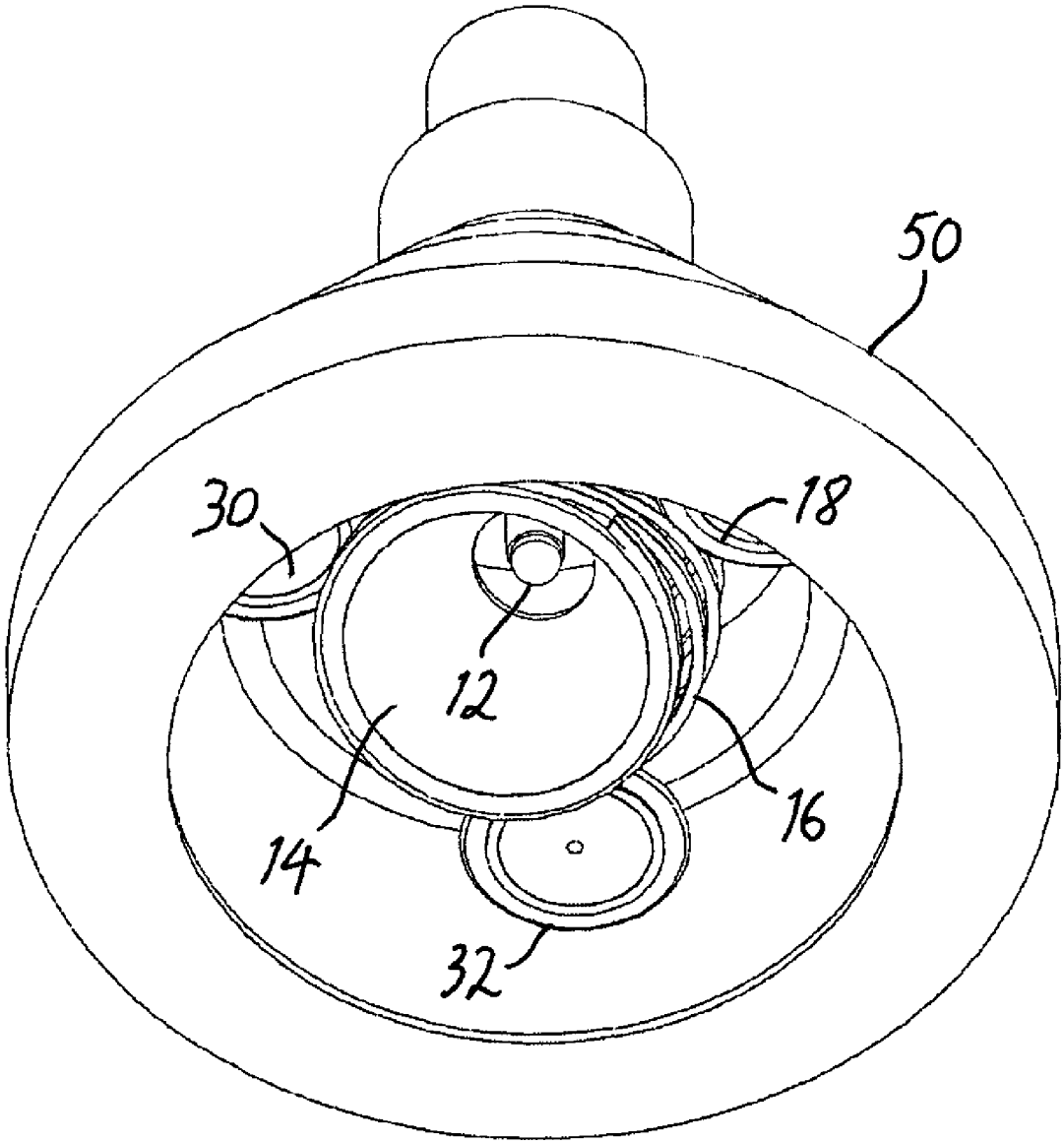
FIG. 17 is a perspective view of the adjustable lighting device according to another application thereof.

The light source 12 of the adjustable lighting device 10 may be in any appropriate form. One form of light source 12 can be a LED of high brightness. As depicted in FIG. 17, a standard size light bulb 50 (e.g. PAR 38) can be used to provide a drop-in solution to a user wishing to install the adjustable lighting device 10, or replace the existing lighting device with the adjustable lighting device of the present patent application. The solution is quick and inexpensive because existing lighting fixtures can be used. A number of PAR 38 light bulbs 50 may be installed in a downlight fixture, and the user can use a remote control to turn individual light on and off, or dim the light to a desired illumination level. The size and position of the illumination area can be adjusted by changing the beam size and beam direction of the PAR 38 light bulbs 50. In order to optimize the illumination for different usages, the PAR 38 light bulbs 50 can be programmed to operate in different brightness, different beam sizes and different beam directions. For example, in a "table" mode for a kitchen, only the table area will be illuminated; and in a "sink" mode, only the sink area will be illuminated. In addition to saving energy, the adjustable lighting device 10 disclosed in the present patent application can also bring enjoyment of stage lighting effect to its users.

Figure 14:
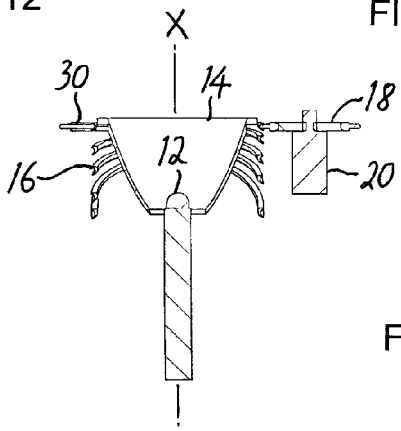
FIG. 14 is a cross sectional view of the adjustable lighting device with the reflector at a rotation angle of 0 degree.
Figure 15:
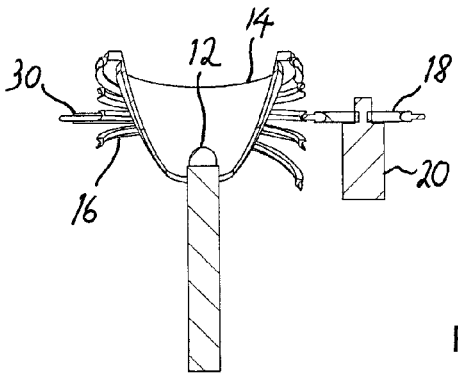
FIG. 15 is a cross sectional view of the adjustable lighting device with the reflector at a rotation angle of 650 degrees.
Figure 16:
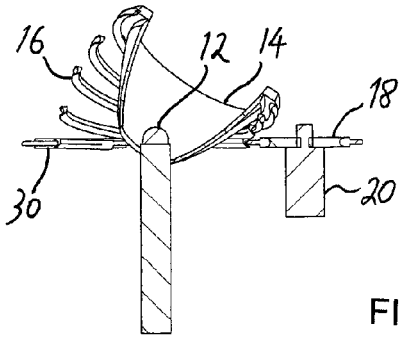
FIG. 16 is a cross sectional view of the adjustable lighting device with the reflector at a rotation angle of 1,390 degrees.

Similarly to the beam-size motor 22, the beam-direction motor 20 may also include an integrated gear box and a multi-turn encoder. The driving wheel 18 may be directly mounted onto the output shaft of the beam-direction motor 20 for driving the coil of nonlinear thread 16 and the reflector 14 around. The driving wheel 18, together with two other freely rotatable support wheels 30, 32, can provide a 3-point support to the coil of nonlinear thread 16 and the reflector 14. When the driving wheel 18 rotates, the coil of nonlinear thread 16 together with the reflector 14 rotates spirally around and nonlinearly outwardly or inwardly due to the interaction between the coil of nonlinear thread 16 and the wheels 18, 30, 32, as illustrated in FIGS. 14-16.

In order to keep the light source 12 near the focal point of the reflector 14 and maintain a constant beam size, the beam-size motor 22 may operate together with the beam-direction motor 20. In such a way, the movement of reflector 14 will not affect the relative position of the light source 12 to the focal point of the reflector 14.

According to the requirements on optical effects of the adjustable lighting device 10, the coil of nonlinear thread 16 disclosed in the present patent application can be manufactured by a method including the steps of (A) setting the diameter of the coil of nonlinear thread; (B) setting the height of the coil of nonlinear thread; (C) setting the maximum tilt angle of the reflector; (D) setting the number of rotation of the reflector and the location of circles; (E) generating the thread position by interpolation; (F) calculating the illuminated location on the light receiving plane; and (G) generating 3D modeling data. Details of the above steps will be described hereinbelow.

A. Set the Diameter of the Coil of Nonlinear Thread

The diameter of the coil of nonlinear thread 16 can be larger than the diameter of the reflector 14. For example, the diameter of the coil of nonlinear thread 16 can be larger than the diameter of the reflector 14 by 6 mm which should be sufficient enough when taking the dimension of the coil of nonlinear thread 16 into consideration.

B. Set the Height of the Coil of Nonlinear Thread

The relationship of the diameter and height of the reflector 14 may follow a parabolic function or other more complex mathematical functions. The optical requirement of the reflector 14 determines the height of the reflector 14. The height of the coil of nonlinear thread 16, i.e. the distance between the two opposite ends of the coil of nonlinear thread 16, can be approximately the same as the height of the reflector 14.

C. Set the Maximum Tilt Angle of the Reflector

When the reflector 14 is at its home position (zero rotation), the optical axis of the reflector 14 aligns with the longitudinal axis Z of the lighting device. When the reflector 14 rotates to a new position, the optical axis of the reflector 14 forms an angle with the longitudinal axis Z of the lighting device, and the beam direction changes. (FIGS. 14-16) This angle is called a tilt angle. The tilt angle together with the distance between the reflector 14 and the light receiving plane (e.g. floor) determine the position of the illumination area. For example, the center of illumination area resulted from a tilt angle of 30 degrees and a distance of 2000 mm is located 2000 mm×tan(30)=1154 mm from the normal point of the light receiving plane. Considering a typical PAR 38 lamp with a beam direction ranging from 10 degrees to 30 degrees, a 30-degree maximum tilt angle can be sufficient.

D. Set the Number of Rotation of the Reflector and the Location of Circles

The spiral path of the light beam on the illumination area can be determined by the number of rotations of the reflector 14. There are some constraints on the thread pitch. The thread pitch may be greater than the thickness of the thread. The thickness of the thread may be greater than the thickness of the wheels 18, 30, 32. It is understood that thin wheels, allowing only a small contact surface with the reflector 14, cannot provide sufficient frictional force to drive the reflector 14. The height of the reflector 14 also has a limitation on the number of rotations of the reflector 14. The maximum number of rotations possible for a certain height of the reflector 14 can be calculated using computer software.

Figure 18:
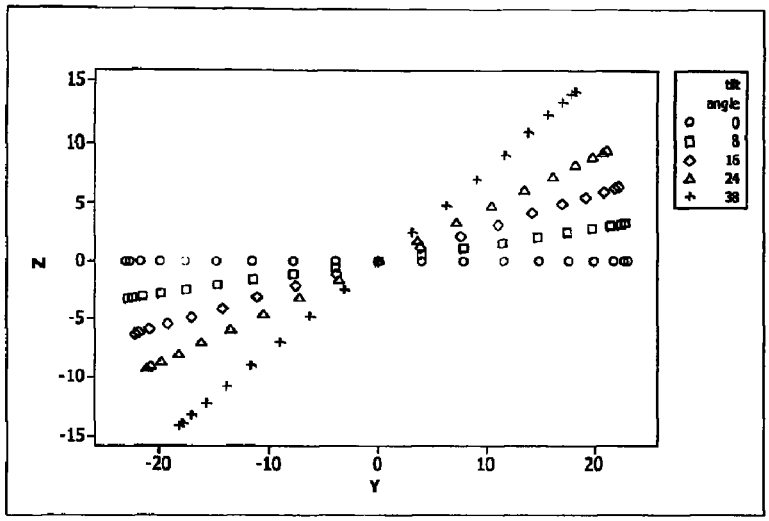
FIG. 18 is a graph showing each rotation being represented by a circle of corresponding tilt angle.

As shown in FIG. 18, each rotation and its tilt angle can be represented by a circle. It should be understood that one extra circle of a larger tilt angle should be added. The use of this extra circle is for the generation of the thread points of the rotation of the original largest tilt angle. The circles representing the rotations should have centers located on the same plane (e.g. x=0 plane) for subsequent thread generation use. The locations of the centers should be derived using a rotation and translation method in order to keep the focal point of the reflector 14 on the axis of shaft 24 driven by the beam-size motor 22.

Figure 19:
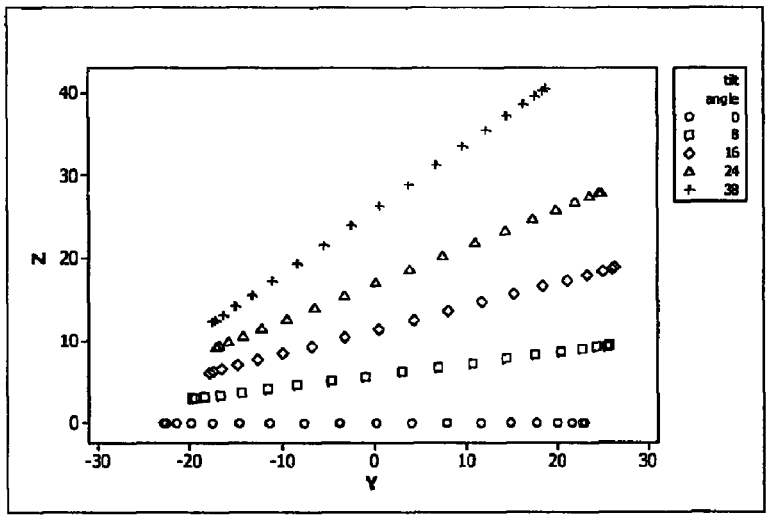
FIG. 19 is a graph showing each circle being translated to corresponding locations using new center coordinates.
Figure 20:
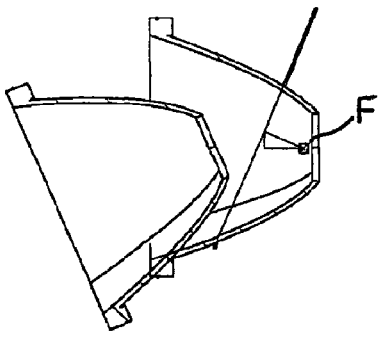
FIG. 20 is an illustrative diagram showing the focus of the reflector.

FIG. 19 is a graph showing each circle being translated to corresponding locations using new center coordinates. Y coordinate of the new circle center is for offsetting the Y-shift of focus when the tilted circle moves to the tilt angle=0 position. Y-shift (Z-distance between circle of tilt angle 0 and circle of tilt angle theta)×tan (theta). FIG. 20 is an illustrative diagram showing the focus F of the reflector.

Figure 21:
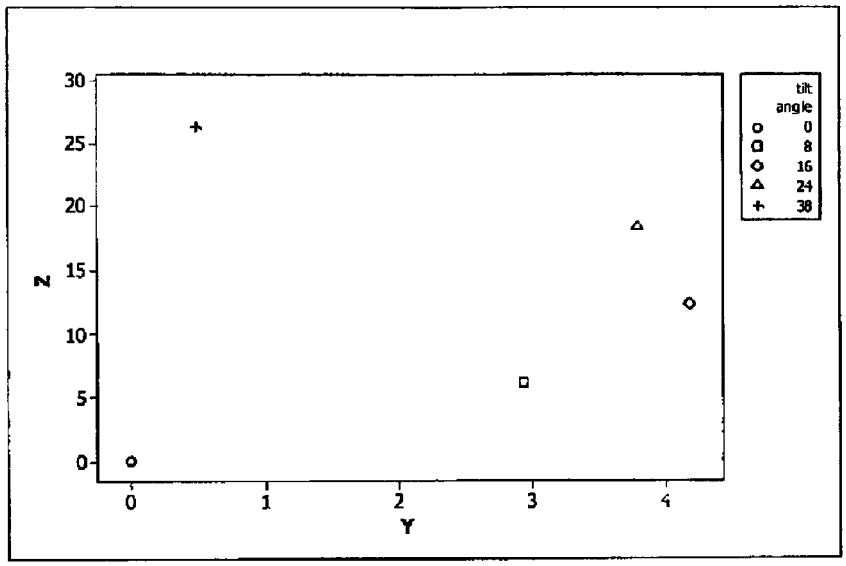
FIG. 21 is a graph showing the Y and Z coordinates of the circles.
Figure 22:
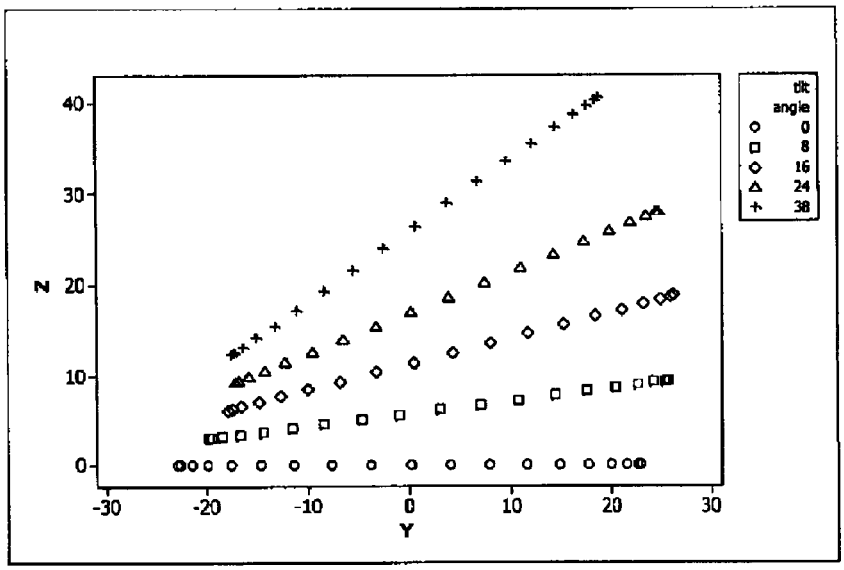
FIG. 22 is a graph showing spacing of circles after several iterations by using spreadsheet software.

FIG. 21 is a graph showing the Y and Z coordinates of the centers of the circles. By using spreadsheet software, it can be very easy and quick to find a good spacing of circles after several iterations, as shown in FIG. 22.

E. Generating the Thread Positions by Interpolation

The purpose of this step is to generate N sets of X, Y, Z coordinates per rotation using the coordinates of the circles of different tilt angles. When the Z coordinate of a point is interpolated from the two points of two adjacent circles, X, Y coordinates of the point remain the same after interpolation. N may be multiple of 36 for easy understanding. 3D solid modeling software such as Solidworks™ can further generate very smooth thread models using 36 coordinates per rotation. The generated model data can be used for the actual manufacturing of the coil of nonlinear thread 16.

Figure 23:
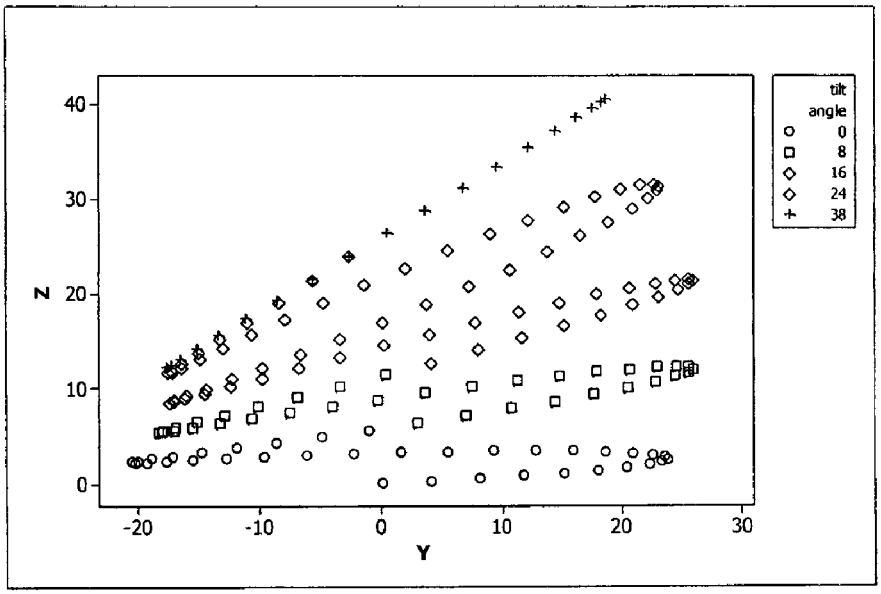
FIG. 23 is a graph showing the coil of nonlinear thread generated from five circles.

FIG. 23 is a graph showing the coil of nonlinear thread 16 generated from five circles. The principle of the interpolation is that the nonlinear thread position of rotation angle theta (θ) lies on a line connecting the two points of adjacent circles of the same angle θ. When θ=0, the nonlinear thread point is same as the point of the circle of a smaller tilt angle. When θ=360, the nonlinear thread point is same as the point of the circle of a larger tilt angle. The distance of a nonlinear thread point from the corresponding point on the circle of a smaller tilt angle is proportional to the rotation angle. For example, Z coordinates of rotation angle 230 degrees are as follows:

$$Z_{coil\ of\ nonlinear\ thread}=(Z_L-Z_S)\times 23/36+Z_S$$

where $Z_L$ is the Z coordinate of rotation angle of 230 degrees of the circle of a larger tilt angle, and $Z_S$ is the Z coordinate of rotation angle of 230 degrees of the circle of a smaller tilt angle.

Figure 24:
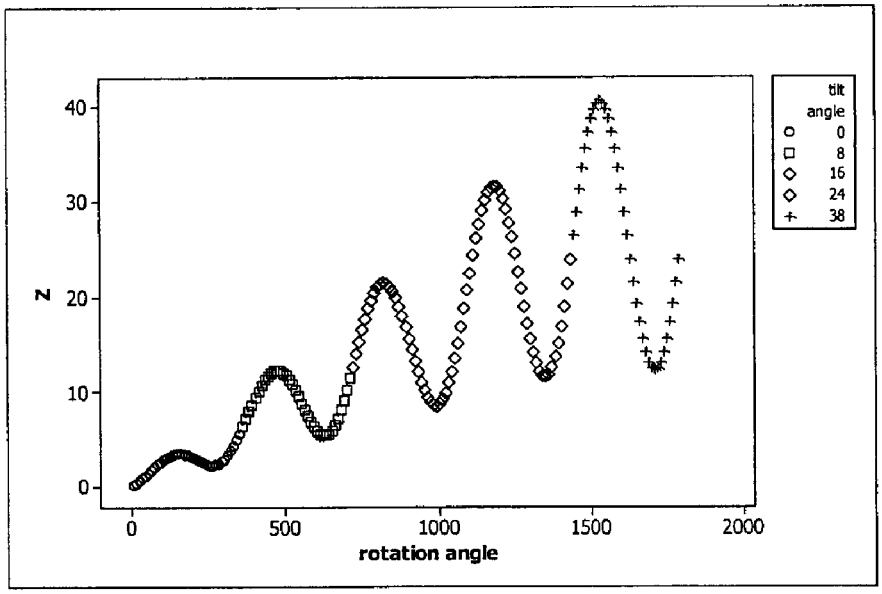
FIG. 24 is a graph showing the coil of nonlinear thread with reference to rotation angle.
Figure 25:
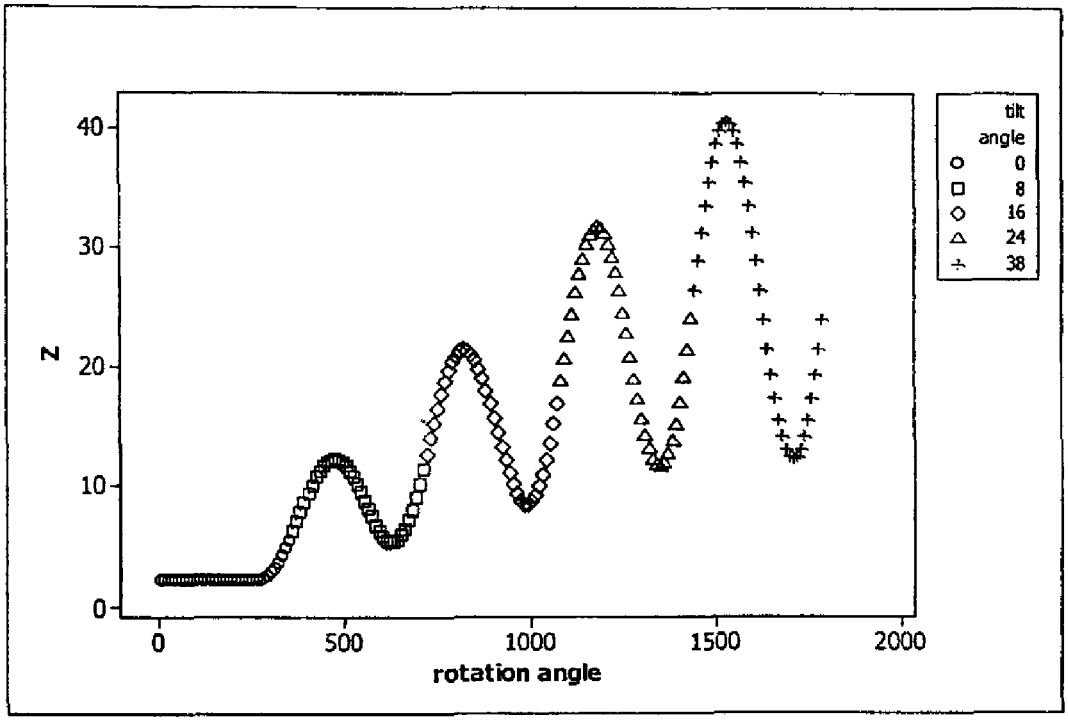
FIG. 25 is a graph showing the first part of the coil of nonlinear thread forced to be constant for 260 degrees so that the tilt angle at the first 20 degrees of rotation remains zero.

FIG. 24 is a graph showing the nonlinear thread with reference to rotation angle. FIG. 25 is a graph showing the first part of the nonlinear thread forced to be constant for 260 degrees so that the tilt angle at the first 20 degrees of rotation remains zero.

F. Calculating Corresponding Locations on the Light Receiving Plane

Figure 26:
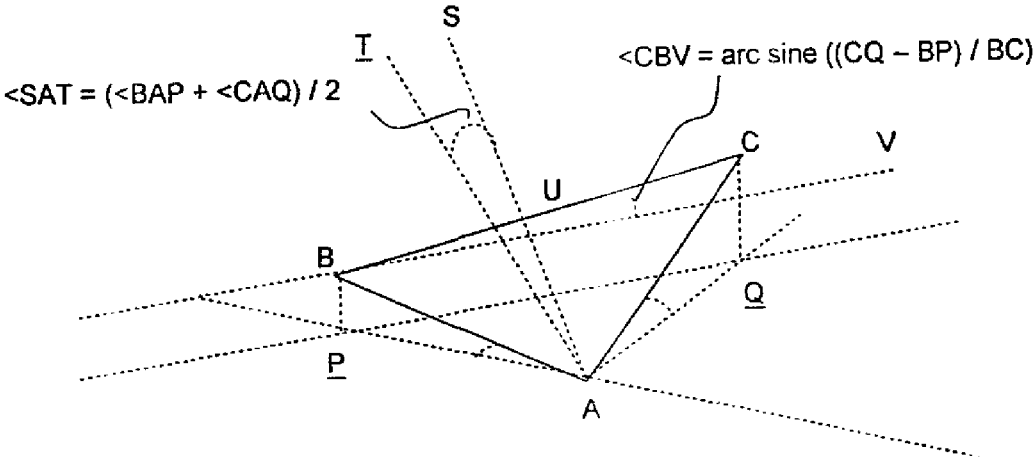
FIG. 26 shows the calculation of the corresponding locations on the light receiving plane.

The purpose of this step is to see whether the illuminated locations on the light receiving plane (e.g. a floor) satisfy the user's requirement. FIG. 26 shows the calculation of corresponding locations on the light receiving plane. The reflector 14 is driven by the driving wheel 18 at point A and supported by the two support wheels 30, 32 at points B and C respectively. An imaginary plane is added to the diagram for the sake of easy understanding the working principle. The tilted angle is zero when the reflector 14 is at its home position. When the reflector 14 rotates, the center axis of the reflector 14 is tilted to an angle as determined by the heights of the contact points A, B and C relative to the imaginary plane. The beam direction corresponding to a particular point on the coil of nonlinear thread 16 touching the driving wheel 18 can be broken into two components: (1) tilt angle which is formed by the center of the line connecting the contacting points B, C of the two support wheels 30, 32 respectively, and the contacting point A of the driving wheel 18, and the plane of the circle with tilt angle=0; and (2) inclination angle which is formed by the line connecting the contacting points B, C of the two support wheels 30, 32, and the plane of the circle with tilt angle=0.

Figure 27:
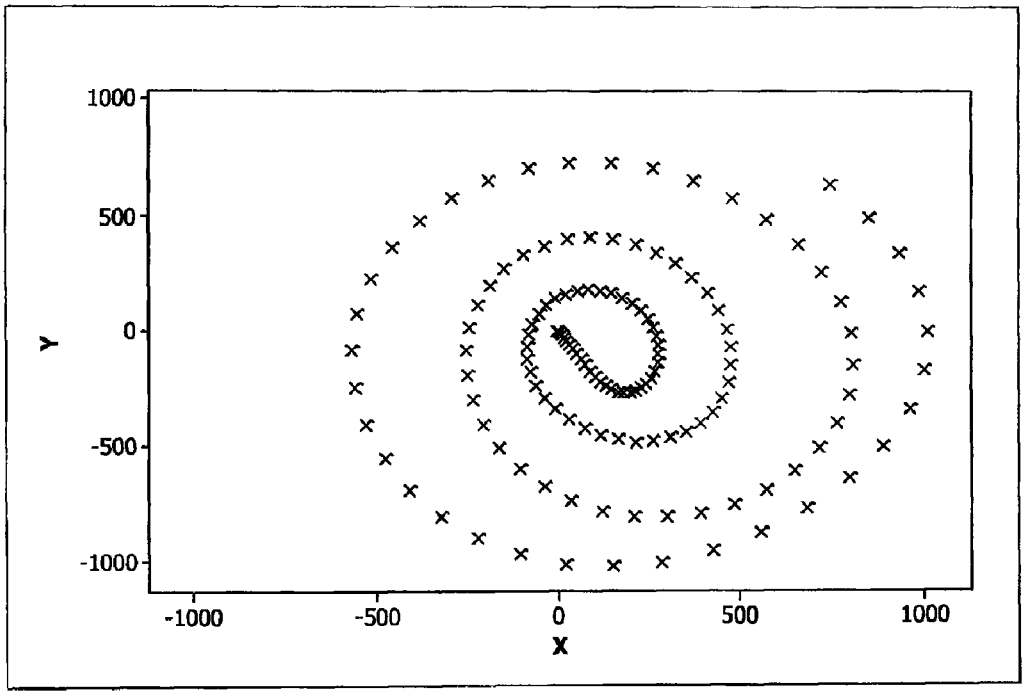
FIGS. 27 and 28 show the illumination areas on the light receiving plane.
Figure 28:
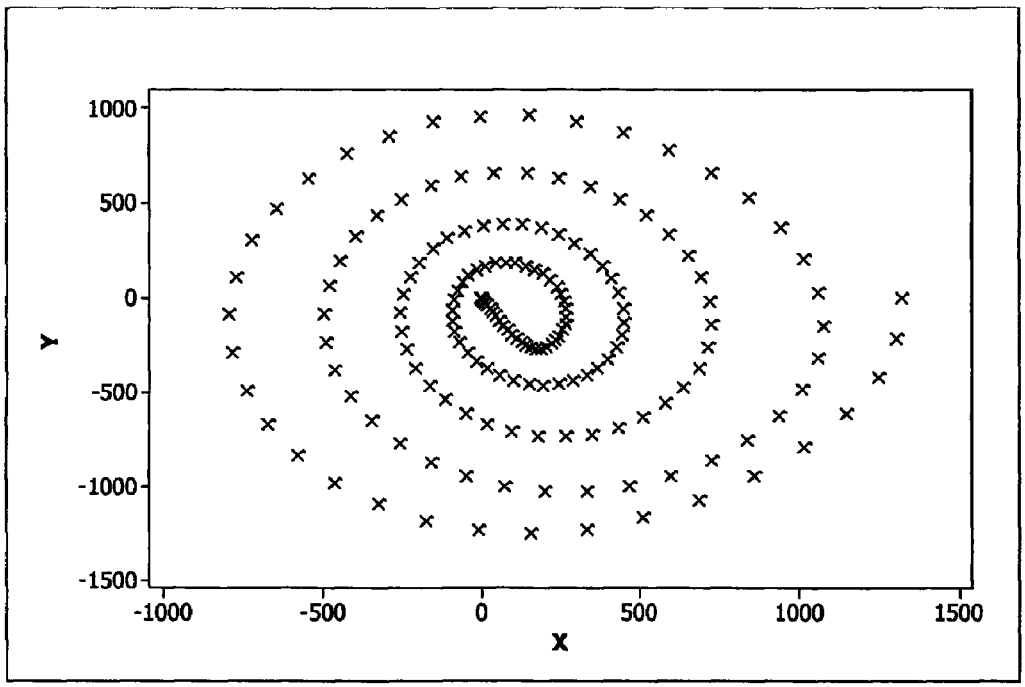

FIGS. 27 and 28 are graphs showing the illuminated areas (in mm) on the light receiving plane. When the reflector 14 rotates spirally and outwardly from its home position, the illumination area will follow a spiral path with its radius from the center of the spiral path increasing with the number of turns of the reflector 14. As an example, the center of the illumination area of the light receiving plane (2000 mm away) is given by the X Y coordinates, wherein X=2000 tan (tilt angle) and Y=2000 tan (inclination angle).

G. Generating 3D Modeling Data 3D solid modeling software such as Solidworks™ can generate very smooth thread models using the nonlinear thread data generated above.

While the adjustable lighting device disclosed in the present patent application has been shown and described with particular references to a number of preferred embodiments thereof, it should be noted that various other changes or modifications may be made without departing from the scope of the appending claims.

What is claimed is:

1. An adjustable lighting device comprising:

a light source;

a reflector for reflecting light from the light source;

a coil of nonlinear thread coiling around the reflector, the coil of nonlinear thread coiling and the reflector being in a fixed positional relationship; and a driving wheel frictionally engaging with the coil of nonlinear thread, the driving wheel adapted to drive the coil of nonlinear thread to rotate thereby adjusting the position of the reflector;

two supporting wheels along with the driving wheel providing a three-point support for the coil of nonlinear thread;

a first motor adapted to drive the driving wheel;

a shaft on which the light source is supported; and a second motor adapted to the shaft axially along an axis of the shaft thereby moving the light source in or out of a focal point of the reflector.

2. The device as claimed in claim 1, wherein the coil of nonlinear thread comprises a helical groove along which a projection of the driving member engages.

3. The device as claimed in claim 1, wherein the coil of nonlinear thread comprises a helical projection along which a groove of the driving member engages.

4. An adjustable lighting device comprising:

a light source;

a reflector for reflecting light from the light source;

a coil of nonlinear thread coiling around the reflector;

a driving wheel frictionally engaging with the coil of nonlinear thread, the driving wheel adapted to drive the coil of nonlinear thread to rotate thereby adjusting the position of the reflector; and two supporting wheels along with the driving wheel providing a three-point support for the coil of nonlinear thread.

5. The device as claimed in claim 4, wherein the coil of nonlinear thread comprises a helical groove along which a projection of the driving wheel engages.

6. The device as claimed in claim 4, wherein the coil of nonlinear thread comprises a helical projection along which a groove of the driving wheel engages.

7. An adjustable lighting device comprising:

a light source;

a reflector for reflecting light from the light source;

a coil of nonlinear thread coiling around the reflector; and a driving member engaging with the coil of nonlinear thread, the driving member adapted to drive the coil of nonlinear thread to rotate thereby adjusting the position of the reflector.

8. The device as claimed in claim 7, wherein the coil of nonlinear thread frictionally engages with the driving member and is rotatable by the driving member via friction.

9. The device as claimed in claim 7, wherein the coil of nonlinear thread is rotatable by the driving member via gear mechanism.

10. The device as claimed in claim 7, wherein the coil of nonlinear thread comprises a helical groove along which a projection of the driving member engages.

11. The device as claimed in claim 7, wherein the coil of nonlinear thread comprises a helical projection along which a groove of the driving member engages.

12. The device as claimed in claim 7, wherein the coil of nonlinear thread is generally in the shape of a section of a toroidal coil of circular cross section with varying coil angle.

13. The device as claimed in claim 7, wherein the driving member is in the form of a rotatable driving wheel.

14. The device as claimed in claim 7, further comprising two supporting members along with the driving member to provide a three-point support for the coil of nonlinear thread.

15. The device as claimed in claim 14, wherein the supporting members are freely rotatable wheels.

16. The device as claimed in claim 7, further comprising a shaft on which the light source is supported, and a motor adapted to drive the shaft axially along an axis of the shaft thereby moving the light source in or out of a focal point of the reflector.

17. The device as claimed in claim 7, wherein the coil of nonlinear thread comprises a plurality of reinforcing rod members attached to the coil of nonlinear thread.

18. The device as claimed in claim 7, wherein the coil of nonlinear thread is fixedly attached to an outer surface of the reflector.

19. The device as claimed in claim 7, wherein one end of the coil of nonlinear thread is fixedly mounted to the reflector.

20. The device as claimed in claim 7, wherein the coil of nonlinear thread is embedded in an outer surface of the reflector.

* * * * *